United States Patent [19]

Haynes

[11] 4,325,233

[45] Apr. 20, 1982

[54] KELLY AND KELLY DRIVE BUSHING

[75] Inventor: Charles W. Haynes, Spring, Tex.

[73] Assignee: Joy Manufacturing Company, Pittsburgh, Pa.

[21] Appl. No.: 103,258

[22] Filed: Dec. 13, 1979

[51] Int. Cl.[3] ..... F16D 3/00

[52] U.S. Cl. ..... 64/23.5; 175/195

[58] Field of Search ..... 64/23.5, 23.6; 175/195

[56] References Cited

U.S. PATENT DOCUMENTS

| | | | |
|---|---|---|---|
| 1,067,330 | 7/1913 | Griffin . | |
| 2,202,446 | 5/1940 | Esseling . | |
| 2,210,506 | 8/1940 | Smith | 64/23.5 |
| 2,338,093 | 1/1944 | Caldwell . | |
| 2,620,163 | 12/1952 | Stone . | |
| 2,829,866 | 4/1958 | Colquitt . | |
| 2,859,939 | 11/1958 | Petrell . | |
| 2,952,826 | 9/1960 | Webster et al. | 64/23.5 |
| 3,035,424 | 5/1962 | Spiri . | |
| 3,099,917 | 8/1963 | Spiri . | |
| 3,433,033 | 3/1969 | Watson | 175/195 |
| 3,513,665 | 5/1970 | Crickmer . | |
| 3,527,064 | 9/1970 | Crickmer | 64/23.5 |

*Primary Examiner*—P. S. Lall

*Attorney, Agent, or Firm*—William J. O'Rourke, Jr.

[57] ABSTRACT

An improved kelly is provided with a drive section which has a uniform cross section defined by three generally flat drive sides alternating with three generally arcuate sides. The three arcuate sides are spaced an equal radii from the central axis of the kelly and the three flat drive sides lie in planes that form an equilateral triangle therebetween.

The improved kelly is driven by an improved mating kelly drive bushing which has three rollers positioned so as to evenly transmit torque to the three flat drive sides of the kelly simultaneously.

15 Claims, 6 Drawing Figures

KELLY AND KELLY DRIVE BUSHING

BACKGROUND OF THE INVENTION

The present invention relates to rotary drilling apparatus and more particularly to an improved kelly and a drive bushing for rotating the kelly.

As is well known in oil well drilling, a swivel supported kelly is rotatably driven by a kelly bushing which also permits translational movement of the kelly into a well hole. The driving torque for the kelly is transmitted by a rotary table driven master bushing to the kelly bushing through either a pin or square type drive forming part of the kelly bushing.

Due to the tremendous magnitude of weight and torque imposed on the kelly during the drilling operation, a kelly needs to be strong in tension and in torsion as well as to be equally strong in bending in all directions. As is well known, a slightly bent kelly will produce enough resistance to the longitudinal movement of the kelly through the drive bushing to prohibit its passage therethrough. Furthermore, a slight bend in the kelly causes misalignment of the drill pipe in the bore hole resulting in an uncontrolled wobble that produces deleterious forces that can cause severe damage to the various components of the drilling apparatus.

For most bore hole dimensions, the maximum strength kelly is yielded by a kelly having a circular cross-sectional area such as the one shown in U.S. Pat. No. 2,202,446. Although, the circular kelly is recognized as one of high strength, it suffers from the problem of the absence of practical means for rotating same. Thus, over the years, several other shaped kellys have been developed; such as: a circular kelly provided with longitudinally extending flutes or grooves as illustrated in U.S. Pat. Nos. 2,620,163; 2,338,093 and 2,859,939; a circular kelly provided with longitudinal extending external ribs as exemplified in U.S. Pat. Nos. 1,067,330 and 2,829,866; and polygonal cross-sectional kellys having a square shape as illustrated in U.S. Pat. No. 3,527,064 and those of the hexagonal shape as illustrated in U.S. Pat. No. 2,338,093.

Among the most popular of these kellys are those having the square or hexagonal shape. Both of these shaped kellys are normally driven by a drive bushing having four rollers. In the case of the square kelly, each of the four rollers are essentially cylindrical and equally spaced about the axis of the bushing and so positioned to driveably engage respective sides of the kelly. In the case of the hex kelly, two of the cylindrical rollers are replaced with V-shaped rollers such that the two remaining cylindrical rollers driveably engage two diametrically opposite sides of the kelly whereas the two diametrically opposed V-shaped rollers driveably engage the corresponding adjacent sides of the kelly at the corners formed thereby which theoretically results in roller engagement of all six sides of the hex kelly. In such drive arrangements it has been found that instead of having a line contact between the rollers and sides of the kelly there is actually a point contact. This is largely due to wear of the surfaces of the components after limited use and due to the fact that clearance space is required between the rollers and the kelly to permit longitudinal movement of the latter through the bushing during the drilling operation. Such point contact normally occurs at or very near the corners of the kelly during the driving operation, and thus after continued used, the corners of the kelly wear to a degree which decreases the frictional drive engagement by the rollers to a point where slippage occurs resulting in damage to the rollers and replacement of the kelly.

Thus, it is desirable to have a kelly for a given bore hole having a cross-sectional area that approaches that of a circular kelly and which is greater than the cross-sectional area of a standard square or hexagonal kelly so as to maximize the strength of the kelly. Further, it is desirable that the kelly has flat drive surfaces similar to the square and hex kelly to facilitate the driving of same which is one of the shortcomings of the circular kelly. Furthermore, it is desirable that the kelly has a sufficient cross-sectional area that the corners thereof are of sufficient strength so as to prevent excessive wear thereto due to the point drive contact of the rollers to thereby prolong the useful life of the kelly. Still further it is desirable to have a kelly drive bushing that driveably cooperates with the kelly such that the bushing rollers are in drive engagement with the flat drive surfaces of the kelly simultaneously.

SUMMARY OF THE INVENTION

Accordingly, it is one of the principal objects of the present invention to provide an improved kelly which is stronger in tension and in torsion compared to a square or hex kelly adapted to be received within a given bore hole.

Another object of the present invention is to provide an improved kelly having a cross-sectional area which approximates that of a circular kelly but which is provided with flat drive surfaces to facilitate driving of same.

Still another object is to provide an improved kelly having flat drive surfaces wherein the corners thereof are stronger than comparable square and hex kellys so as to reduce the wear thereof and prolong the useful life of the kelly.

A still further object of the present invention is to provide an improved kelly drive bushing for driveable cooperation with the improved kelly of the present invention such that the bushing rollers simultaneously driveably engage the respective flat drive surfaces of the kelly.

Yet another object is to provide an improved kelly drive bushing which driveably cooperates with the shape of the improved kelly as well as with a standard hex kelly.

In furtherance of these and other objects, the present invention sets forth an improved kelly having an elongated six sided drive section with a longitudinally extending central axis of rotation. Preferably, the drive section has a substantially uniform cross-section with three arcuately spaced flat drive sides alternating with three arcuate sides. The arcuate sides are spaced an equal radii from the central axis of the kelly. Each of the three flat sides has a midpoint spaced the same radial distance from the central axis with the radial distance being less than the radius of the arcuate sides.

More particularily, the three flat drive sides of the kelly lie in planes that form an equilateral triangle therebetween. Still further, the three flat drive sides are preferably equal in length and the arcuate extent of the three arcuate sides are preferably equal.

The present invention further includes an improved kelly drive bushing which is adapted to driveably cooperate with the improved kelly as well as with a standard hex kelly. More specifically, the improved bushing includes three rotatably mounted rollers with cylindrical outer surfaces having lines of engagement with the drive sides of the kelly lying essentially in the planes defined by the drive sides for simultaneous drive engagement of the drive sides. The respective axis of the rollers are positioned radially outwardly of the central axis of the drive bushing and are parallel to respective ones of the drive sides.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

Figure 2:
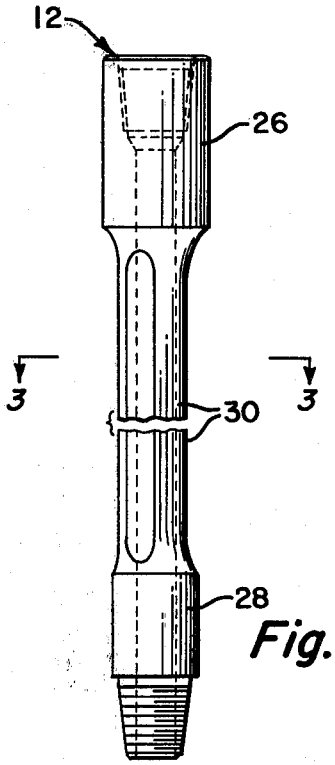
FIG. 2 is a front elevational view of the improved kelly of FIG. 1 being removed from the drilling apparatus.

FIG. *3a* is a cross-section of the drive section of the improved kelly taken along lines 3—3 of FIG. 2.

FIG. *3b* is an illustrative view showing in cross-section the improved kelly (represented by solid lines a), the cross-section of a comparable square kelly (represented in dotted lines c), and a comparable hexagonal kelly (represented in dashed lines b).

Figure 4:
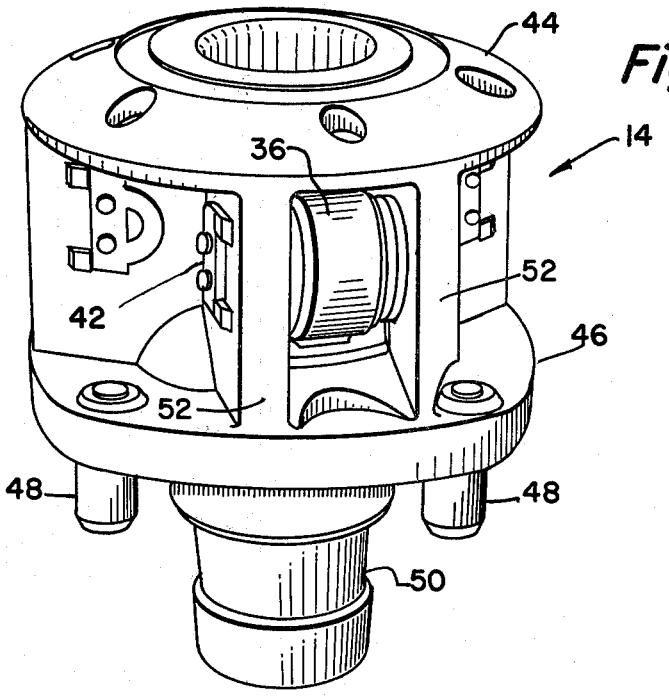

FIG. 4 is a perspective view of the improved kelly drive bushing being removed from the drilling apparatus.

Figure 1:
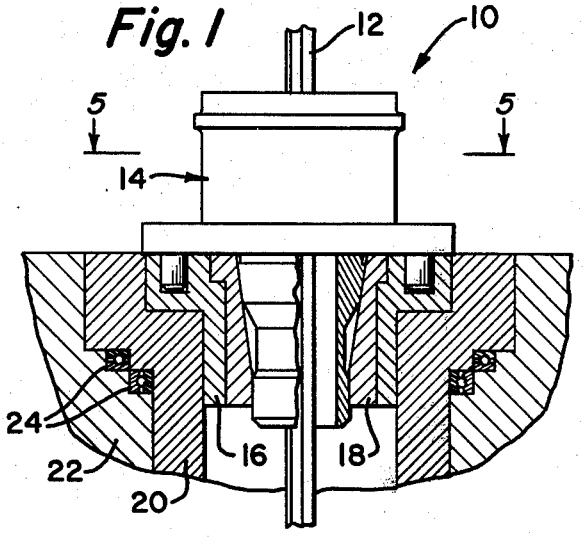
FIG. 1 is a fragmentary front elevational view, partly in section, of a drilling apparatus incorporating the principles of the present invention with the improved kelly extending within and in drive engagement with the improved kelly bushing.
Figure 5:
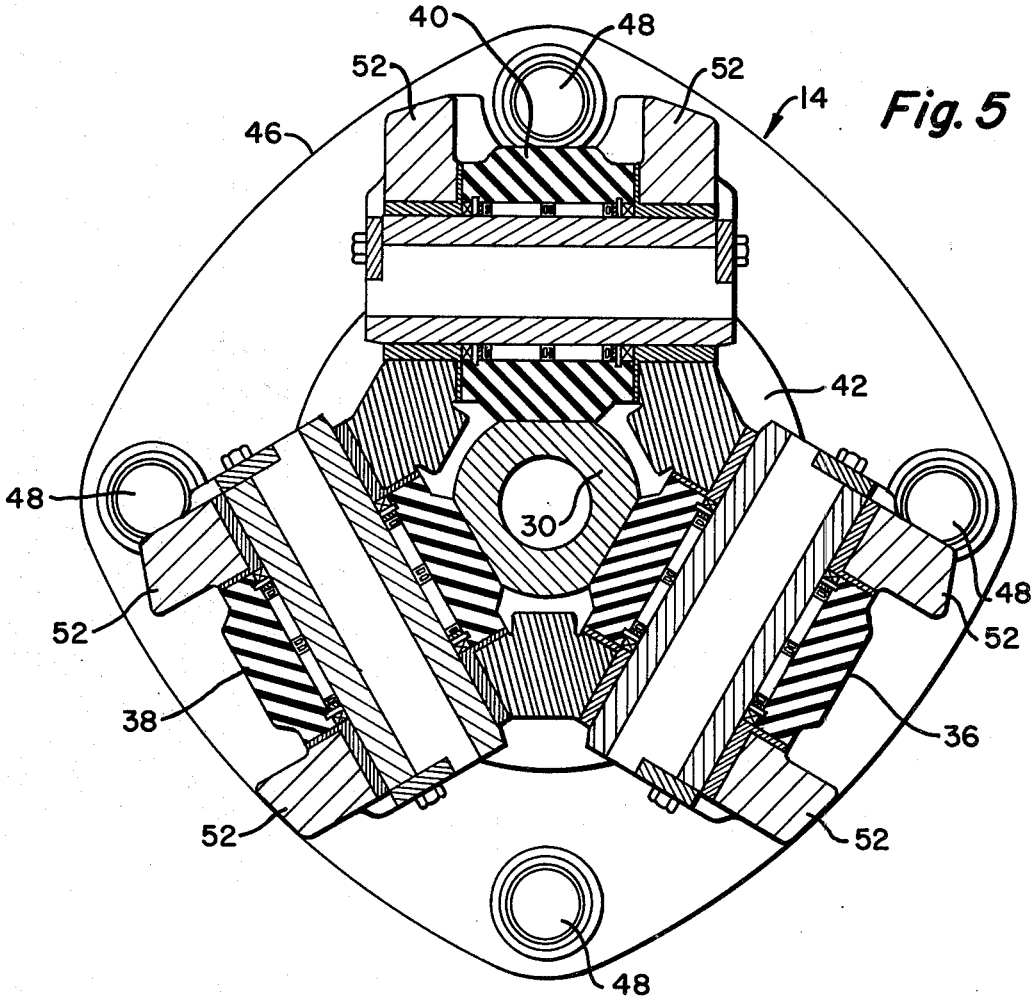

FIG. 5 is a cross-sectional view through the improved kelly and kelly bushing as taken along lines 5—5 of FIG. 1.

DETAILED DESCRIPTION OF THE PREFERRED EMBODIMENT OF THE INVENTION

In the following description, like numerals appear on several drawings to identify the same components. Also, in the following description, it is to be understood that such terms as "forward", "rearward", "left", "right", "upwardly", "downwardly", and the like, are words of convenience and are not to be construed as limiting terms.

IN GENERAL

Referring now to the drawings, and particularly FIG. 1, there is shown a fragmentary view of a drilling apparatus of well known construction, being indicated generally by the numeral 10, which incorporates a preferred embodiment of the invention. The drilling apparatus 10 basically includes a swivel (not shown) supported elongated kelly 12 supported within a kelly drive bushing 14 which rotatably drives the kelly 12 about a vertical axis while at the same time permitting relative vertical movement of the kelly 12 to advance a connected drill string (not shown) downwardly within a well hole.

The kelly bushing 14 is of the pin type drive and is supported on a master bushing assembly that includes a master bushing 16 and insert bowl 18. The master bushing assembly is arranged to be rotatably driven in a well known manner in a suitably rotatably driven rotary table 20 which rotary table is suitably supported by a rotary table frame 22 on bearings 24. For a more thorough and complete understanding of the operation and interrelationship of the rotary table, master bushing assembly and kelly bushing, reference is made to U.S. Pat. No. 3,527,064 which is also assigned to the present assignee. Furthermore, it should be pointed out here that even though the kelly bushing shown is of the pin type drive, the principles of the present invention are equally applicable to the square type drive bushings.

IMPROVED KELLY

Figure 3A:
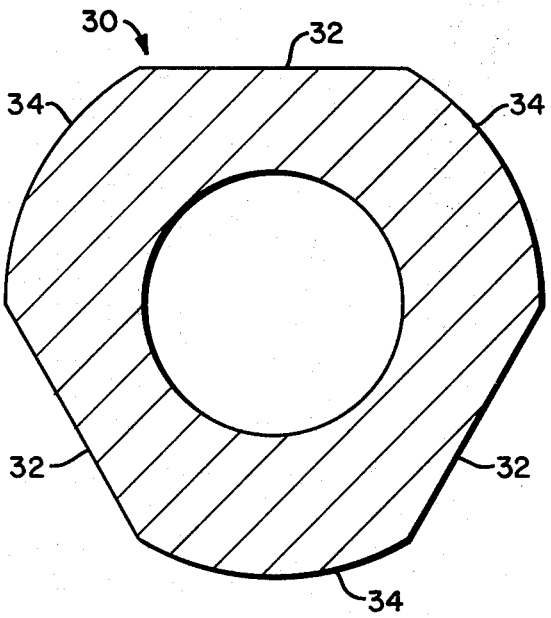
Figure 3B:
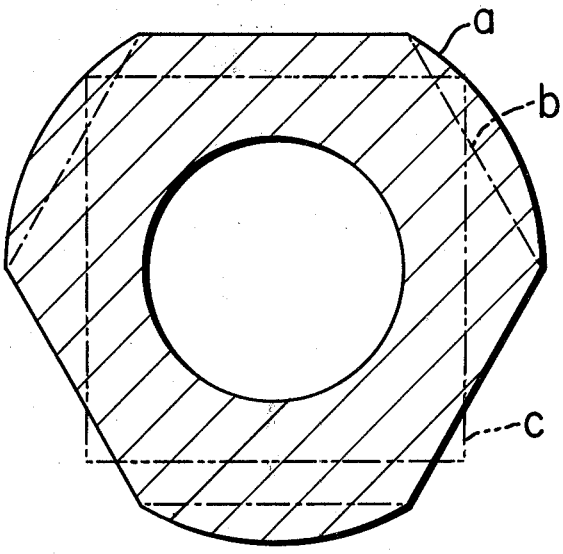

Turning to FIGS. 2 and 3, the improved kelly 12 will now be discussed in detail. The kelly 12, being elongated, basically includes an upper conventional female end portion 26, a lower conventional male end portion 28, and an improved drive section 30 extending longitudinally between the end portions 26, 28. The upper female end portion 26 contains internal threads for receiving a swivel mechanism (not shown) whereas the lower male end portion 28 contains external threads for connection to a drill string (not shown).

As best seen in FIG. 3, the drive section 30 of the kelly 12 has a uniform cross-section defined by three substantially flat drive sides 32 alternating with three substantially arcuate sides 34. The three flat drive sides 32 lie in planes that form an equilateral triangle therebetween with the center of the equilateral triangle being concentric with the central axis of the kelly such that the perpendicular radial distances from the midpoint of each of the drive sides 32 to the central axis are equal.

The arcuate sides 34 extend arcuately between adjacent pairs of the respective drive surfaces 32 with the radially inward ends thereof terminating at the respective ends of the drive sides 32. In other words, the three arcuate sides 34 are spaced an equal radii from the central axis of the kelly 12 which radii is greater than the radial distance from the central axis to the midpoint on each of the drive sides 32.

In the preferred embodiment, the length of the drive sides 32 are substantially equal and the arcuate extent of each of the arcuate sides are substantially equal. Furthermore, the respective chords associated with each of the arcuate sides 34 are substantially equal, and preferably, these chords are substantially equal in length to the length of each of the drive sides 32.

In FIG. *3b* which is an illustrative cross-sectional view of the improved kelly 12 represented in solid lines a, a hexagonal kelly represented in dashed lines b, and a square kelly represented in dotted lines c, the cross-sectional areas of comparable square, hexagonal, and the improved kelly are shown. As discussed herein, comparable size kellys are those kellys which can be received by a standard size casing.

As can be easily seen and readily calculated from FIG. *3a*, the cross-sectional area of the square kelly "c" is less than the cross-sectional area of the hex kelly "b" which is less than the cross-sectional area of the improved kelly "a". For comparable kellys, the cross-sectional area of the improved kelly "a" is approximately 10% more than a hex kelly and approximately 36% more than a square kelly. This results in the improved kelly being approximately 29% stronger in bending, 12% stronger in tension, and 32% stronger in torsion when compared to the drive section of a hex kelly.

Furthermore, it can be appreciated from FIG. 3*a* that the drive section of the improved kelly has corner supports which decrease the tendency of the corners to roll over as experienced with the corners of the hexagonal and square kelly.

The unique shape of the improved kelly incorporates more steel for higher strength and longer life. For comparison of the improved kelly to square and hexagonal kellys, the following table is provided. It should be noted here that all values have no safety factor and are based on 110,000 psi minimum tensile yield strength and a shear strength of 57.7% of the minimum tensile yield strength. Furthermore, the values for the improved "a" kelly appear in the second column of the first three headings and in the second and fourth columns of the fourth heading.

TABLE I

STRENGTH OF KELLY DRIVE SECTIONS

| Kelly Size and Type | Kelly Bore In. | Minimum Recommended Casing O. D. In. | | Tensile Yield of Drive Section lbs. | | Torsional Yield of Drive Section ft.-lbs. | | Yield in Bending ft.-lbs. Through Corners | On Radius | Through Faces | On Flat |
|---|---|---|---|---|---|---|---|---|---|---|---|
| | | | a* | | a* | | a* | | a* | | a* |
| 3½ Square | 2¼ | 6⅝ | 5½ | 886,500 | 825,139 | 35,400 | 49,734 | 36,100 | 43,369 | 55,300 | 43,468 |
| 4¼ Square | 2 13/16 | 8⅝ | 6⅝ | 1,310,000 | 1,176,084 | 61,400 | 87,348 | 63,000 | 76,165 | 97,300 | 76,338 |
| 4¼ Square | 2¾ | 8⅝ | 6⅝ | 1,280,000 | 1,206,120 | 62,900 | 88,509 | 64,400 | 77,171 | 98,600 | 77,344 |
| 5¼ Square | 3¼ | 9⅝ | 8⅝ | 2,082,000 | 1,931,970 | 123,600 | 171,794 | 125,700 | 149,838 | 190,200 | 150,195 |
| 3½ Hex | 1⅞ | 5½ | 5½ | 886,100 | 959,380 | 38,500 | 53,189 | 41,300 | 46,378 | 35,000 | 46,478 |
| 4½ Hex | 2¼ | 6⅝ | 6⅝ | 1,279,500 | 1,422,104 | 69,400 | 95,320 | 74,200 | 83,072 | 62,900 | 83,246 |
| 5¼ Hex | 3 | 8⅝ | 8⅝ | 1,843,000 | 2,072,960 | 125,000 | 177,112 | 134,900 | 154,447 | 113,700 | 154,804 |
| 5¼ Hex | 3¼ | 8⅝ | 8⅝ | 1,707,000 | 1,937,970 | 117,500 | 171,794 | 128,300 | 149,838 | 107,100 | 150,195 |

*"a" kelly of same size and bore

The unique shape of the drive section 30 of the improved kelly 12 insures that the kelly 12 is always centered in the drive bushing 14 and thus wear and vibration are reduced. Another advantage of this improved kelly is that it has higher tensile, bending, and torsional strengths than comparable hexagon or square kellys. Furthermore, the improved kelly 12 has a more uniform bending strength which means it is more resistant to bending in all directions than hex or square kellys of comparable size and thus decreases the tendency of the kelly to bend which is commonly due to dropping, side pull during make-up, and improper tie-down, loading or unloading procedures. Further, the improved kelly 12 is less susceptible to fatigue due to the fact that the larger cross-sectional area lowers the stress level in the drive section 30 and increases the fatique limits thereby enabling the kelly 12 to be better able to tolerate derrick misalignment and drill ship motion. The improved kelly 12 does not have corners susceptible to being rounded off due to wear as on hex and square kellys, thus, prolonging the useful life of the kelly.

IMPROVED KELLY DRIVE BUSHING

As mentioned earlier, the kelly 12 is rotatably driven by an improved kelly drive bushing 14 which will now be discussed in further detail with specific reference to FIGS. 4 and 5.

The drive bushing 14 is similar in construction to known four roller drive bushings, such as the one shown and described in the above-referenced U.S. Pat. No. 3,513,665, but has been modified in structure to include three rollers 36, 38 and 40 that evenly transmit torque to the three flat drive surfaces 32 of the kelly drive section 30 simultaneously. The bushing 14 is of integral construction, preferably a casting, including a rigid tubular main body portion 42 having a longitudinally extending central opening for receiving the kelly 12 therethrough, an upper generally circular cap portion 44, and a lower end portion with an outwardly extending generally square flange 46. Mounted on and extending downwardly from the respective corners of the flange 46 are four short pins 48 that form the pin drive means of the kelly. The pins 48 are received in mating apertures provided in the upper surface of the master bushing 16 (FIG. 1). The bushing 14 is additionally provided with a generally cylindrical tubular downwardly longitudinally extending centering skirt 50 rigidly fixed to the undersurface of flange 46 and coaxial with the central opening.

Each of the rollers 36, 38 and 40 are rotatably mounted between pairs of integral rib members 52 that extend generally vertically between the respective upper and lower end portions 44, 46 of the bushing 14. Only one pair of rib members 52 are shown in FIG. 4. The three pairs of rib members 52 are positioned approximately 120° apart about the central axis of the bushing 14 such that the rollers 36, 38 and 40 are disposed approximately 120° from one another. The axis of the rollers 36, 38 and 40 lie in a generally horizontal plane which plane is generally parallel to flange 46. Additionally, the axes of the rollers 34, 36 and 38 are positioned such that extension thereof would form an equilateral triangle.

With particular reference to FIG. 5, each rotatably mounted roller 36, 38 and 40 has a cylindrical outer surface that forms a line of engagement with the respective flat drive sides 32 of the kelly drive section 30 which line of engagement lies essentially in the respective planes defined by the respective drive sides 32 for simultaneous drive engagement of the drive sides of kelly 12. As can be seen in this three roller design no roller is directly opposite another, instead, each is offset 120° from the other two. Thus, the rollers 36, 38 and 40 transmit rotary torque equally and smoothly, keeping the kelly 12 centered and fully supported at all times. This reduces impact loading on the drive system caused by bending loads, kelly to drive roller clearances, and derrick misalignment.

It is thought that the invention and many of its attendant advantages will be understood from the foregoing description and it will be apparent that various changes may be made in form, construction and arrangement thereof without departing from the spirit and scope of the invention or sacrificing all of its material advantages, the form hereinbefore described being merely a preferred or exemplary embodiment thereof.

What is claimed is:

1. An improved kelly having an elongated six sided drive section with a longitudinally extending central axis of rotation, said drive section having a substantially uniform cross section along the length thereof, with the outer peripheral surface having three arcuately spaced continuous flat drive sides converging and alternating with three continuous arcuate sides, said arcuate sides being spaced a substantially equal radii from said central axis of said kelly, said flat drive sides each having a midpoint spaced substantially the same radial distance from said central axis which radial distance is less than the radius of said arcuate sides.

2. The improved kelly as defined in claim 1, wherein said radius of said radial distance is substantially perpendicular to said drive sides.

3. The improved kelly as defined in claim 1, wherein said three flat drive sides lie in planes that form an equilateral triangle therebetween.

4. The improved kelly as defined in claim 1, wherein said flat drive sides are substantially equal in length.

5. The improved kelly as defined in claim 1, wherein the arcuate extent of said arcuate sides are substantially equal.

6. The improved kelly as defined in claim 1, wherein the chords associated with said arcuate sides are substantially equal to said flat drive sides.

7. An improved elongated kelly including spaced end portions having a minimum longitudinal extent and with a drive section extending longitudinally between said end portions, said drive section having a substantially uniform cross-section along the length thereof consisting of:

three continuous outer linear drive surfaces disposed upon the sides of a series of planes forming an equilateral triangle and three continuous outer surfaces extending arcuately between adjacent pairs of said linear drive surfaces respectively having the radially inward ends thereof converging with the ends of said adjacent linear drive surfaces.

8. The improved kelly as defined in claim 7, wherein said three arcuately extending outer surfaces are spaced an equal radii from the central axis of said kelly.

9. The improved kelly as defined in claim 8, wherein the cross-sectional chord associated with an arcuately extending outer surface is substantially equal in length to the cross-sectional length of an adjacent linear drive surface.

10. The improved kelly as defined in claim 7, wherein the cross-sectional length of said three linear drive surfaces are equal.

11. The improved kelly as defined in claim 7, wherein the radial distance from the central axis of said kelly to the junctions of said linear drive surfaces and said arcuately extending outer surfaces are substantially equal.

12. An improved kelly having a longitudinally extending over peripheral drive section, the cross-section of said drive section being defined by:

three planar continuous drive surfaces spaced an equal distance from a central axis and so oriented such that extension of the planar surfaces forms an equilateral triangle; and three continuous arcuate surfaces alternately spaced and interconnecting adjacent pairs of said planar surfaces with the radius of said arcuate surfaces being greater than the perpendicular distance from said central axis to said planar surfaces.

13. A drilling apparatus comprising:

a drilling kelly having a longitudinally exending six continuous sided outer peripheral drive section with a uniform cross-section defined by three flat drive sides alternating with three arcuate sides; and a kelly drive bushing having three rotatably mounted rollers having cylindrical outer surfaces having a line of engagement with a majority of the length of said flat drive sides lying essentially in the respective planes defined by said flat drive sides for simultaneous drive engagement of said flat drive sides.

14. The drilling apparatus as defined in claim 13, wherein said rollers are rotatably mounted about three individual axes, said axes being positioned radially outwardly of the central axis of said bushing and each roller axis being parallel to a flat drive side.

15. The drilling apparatus as defined in claim 13, wherein each cylindrical outer surface of the roller is engaged with substantially the complete length of the respective flat drive sides of the kelly.

* * * * *